US010441021B1

(12) United States Patent
Polk

(10) Patent No.: US 10,441,021 B1
(45) Date of Patent: Oct. 15, 2019

(54) FOOTWEAR WITH HEEL CONTACT MEMBER

(71) Applicant: Leisure, Inc., Eden Prairie, MN (US)

(72) Inventor: Louis F. Polk, Excelsior, MN (US)

(73) Assignee: Leisure, Inc., Eden Prairie, MN (US)

( * ) Notice: Subject to any disclaimer, the term of this patent is extended or adjusted under 35 U.S.C. 154(b) by 177 days.

(21) Appl. No.: 15/630,027

(22) Filed: Jun. 22, 2017

(51) Int. Cl.
*A43B 3/12* (2006.01)
*A43B 13/18* (2006.01)
*A43B 21/32* (2006.01)

(52) U.S. Cl.
CPC ..... *A43B 3/128* (2013.01); *A43B 3/12* (2013.01); *A43B 13/186* (2013.01); *A43B 13/188* (2013.01); *A43B 21/32* (2013.01)

(58) Field of Classification Search
CPC ..... A43B 3/12; A43B 3/128; A43B 13/186; A43B 13/188; A43B 7/16; A43B 21/32
USPC ..... 36/11.5, 28, 37
See application file for complete search history.

(56) References Cited

U.S. PATENT DOCUMENTS 2,821,793 A * 2/1958 Kornberg ..... A43B 21/32 36/37
2,967,362 A * 1/1961 Montoscuro ..... A43B 21/32 36/37
3,142,910 A * 8/1964 Levine ..... A43B 21/32 36/105
4,267,649 A 5/1981 Smith
4,603,698 A 8/1986 Guttmann Cherniak
4,638,575 A * 1/1987 Illustrato ..... A43B 21/30 36/28
4,910,884 A * 3/1990 Lindh ..... A43B 13/18 36/27
5,596,819 A * 1/1997 Goldston ..... A43B 21/26 36/27
5,649,374 A * 7/1997 Chou ..... A43B 21/30 36/27
5,802,743 A * 9/1998 Chien ..... A43B 7/00 36/11.5
5,896,678 A 4/1999 Ganon
6,314,661 B1 11/2001 Chern
6,519,874 B1 * 2/2003 Dean ..... A43B 7/1415 36/30 R
7,249,425 B2 7/2007 Wang
7,284,341 B2 10/2007 Moseley
7,540,098 B2 6/2009 Bast et al.
7,866,062 B2 * 1/2011 Yang ..... A43B 3/108 36/100
8,434,246 B2 5/2013 Enderson
8,438,757 B2 5/2013 Roser
9,144,265 B2 9/2015 Lubart
9,192,205 B2 11/2015 McDowell
9,332,806 B2 5/2016 Guardado
9,420,848 B2 8/2016 Campos, II et al.
9,538,809 B2 1/2017 Park
(Continued)

*Primary Examiner* — Marie D Bays
(74) *Attorney, Agent, or Firm* — Haugen Law Firm PLLP

(57) ABSTRACT

A footwear device is provided having a deformable heel contact member. The heel contact member extends above a top portion of the footwear's sole and deforms into a cavity formed in the sole when the user's heel applies a force against the heel contact member. The heel contact member is resilient and returns to its original shape when the force against the heel contact member is eliminated. The heel contact member is particularly well suited to reduce heel slap of open heeled footwear.

15 Claims, 29 Drawing Sheets

(56) References Cited

U.S. PATENT DOCUMENTS

| | | | | |
|---|---|---|---|---|
| 2002/0011010 | A1 | 1/2002 | Smith | |
| 2002/0038522 | A1* | 4/2002 | Houser | A43B 7/1415 36/28 |
| 2005/0039348 | A1* | 2/2005 | Raluy | A43B 3/12 36/50.1 |
| 2005/0268488 | A1* | 12/2005 | Hann | A43B 13/20 36/27 |
| 2008/0196270 | A1 | 8/2008 | Small-Vollmann | |
| 2008/0313924 | A1* | 12/2008 | Righetto | A43B 7/144 36/28 |
| 2011/0126422 | A1 | 6/2011 | Vattes et al. | |
| 2011/0138650 | A1 | 6/2011 | Gershon | |
| 2011/0308540 | A1* | 12/2011 | Naftulin | A43B 1/0045 132/200 |
| 2012/0085000 | A1 | 4/2012 | Alaimo | |
| 2013/0118028 | A1* | 5/2013 | Yoon | A43B 13/143 36/27 |
| 2013/0263471 | A1 | 10/2013 | Spinks | |
| 2013/0291397 | A1 | 11/2013 | Barteet | |
| 2013/0291410 | A1 | 11/2013 | Trauner | |
| 2014/0068966 | A1* | 3/2014 | Chaffin | A43B 13/183 36/28 |
| 2014/0259785 | A1 | 9/2014 | Lester et al. | |
| 2015/0059215 | A1 | 3/2015 | Burch | |
| 2015/0289588 | A1* | 10/2015 | Kramer | A43B 13/181 36/28 |
| 2015/0305445 | A1 | 10/2015 | Bachmann | |
| 2016/0066646 | A1* | 3/2016 | Kim | A43B 7/088 36/25 R |
| 2016/0255910 | A1 | 9/2016 | Stover | |
| 2016/0302521 | A1 | 10/2016 | Rennex | |
| 2016/0360825 | A1 | 12/2016 | Pedersen | |
| 2017/0042281 | A1 | 2/2017 | Buck, IV et al. | |

* cited by examiner

FOOTWEAR WITH HEEL CONTACT MEMBER

CROSS-REFERENCE TO

Not Applicable

FEDERAL SPONSORSHIP: RELATED APPLICATIONS

Not Applicable

JOINT RESEARCH AGREEMENT

Not Applicable

TECHNICAL FIELD

The present invention relates generally to footwear. More particularly, the invention relates to sandals and open heeled shoes having a tendency to slap against a user's heel as the wearer walks. The present invention reduces the slapping sound heard when the wearer is walking with the sandal or open heeled footwear.

BACKGROUND

Over the years the evolving use of footwear and the ever changing fashion trends have led to modifications and improvements to shoes and boots. By way of example, the changing function of footwear has led to high heels, flat soles, heeled boots, open toed shoes, sandals, running shoes, mountain climbing shoes and boots, shock absorbing soles, and open heeled shoes and sandals. Open heeled sandals and shoes may include a back strap to keep the heel secure and in contact with the top surface of the shoe or sandal. Alternatively, at times it is desirable to create an open heeled sandal or shoe that does not include a heel strap. Walking in a strapless, open heeled shoe can result in a heel slap as the sole bends while walking. The present invention reduces the heel slap and noise associated with the sole slapping against the wearer's heel.

SUMMARY

Embodiments according to aspects of the present invention provide a heel contact member that reduces the slap and noise associated with the open heeled footwear slapping against the wearer's heel. The heel contact member includes a resilient member that deforms under the heel weight of a user and returns to its relaxed or original form as the heel weight is reduced. When in the relaxed position the heel contact member extends above a top portion of the footwear's sole and when in the deformed position the heel contact member deforms into a cavity formed in the sole. The heel contact member deforms when the user's heel applies a force against the heel contact member and returns to its original shape when the force against the heel contact member is eliminated. The resilient member is positioned towards the back end of the sole and contacts the user's heel to reduce the slapping and flip flop sound while walking. The resilient member and cavity formed in the sole are particularly well suited for footwear that does not include a heel strap or enclosed back heel extending upwardly from the sole (for example, open heeled footwear) to reduce the flopping sound when a user walks in the footwear.

The footwear in accordance with aspects of the present invention may include a sole member, foot retaining member, heel portion of the sole and a resilient or pliable body fixed to the heel of the footwear. The sole member has a top portion and a bottom portion, wherein the top portion of the sole member may be characterized by a toe receiving segment, a mid-segment, and a heel receiving segment. The foot retaining member is coupled to the sole member near the mid segment of the sole. The foot retaining segment may include a toe segment that couple to a toe portion on the sole of a sandal. The heel receiving segment of the sole member includes a cavity formed in and extending into the sole member. The cavity is formed into the sole at the heel receiving segment, wherein the cavity extends into the sole member from the top portion of the sole member. One or both ends of the resilient or pliable body are coupled to the sole member at the heel receiving segment of the sole member. At least one of the first end and second end of the pliable body extends into the cavity formed in the sole member.

Embodiments of the invention include a foot retaining member that is comprised of a strap having opposing ends of the strap fixed to the sole member at the mid segment of the sole member. The resilient or pliable body may have a heel contact portion that extends above the top portion of the sole member when the pliable body is in a relaxed position. The pliable body deforms when a force is directed towards the heel contact segment. When the pliable body deforms at least a portion of the pliable body recedes into the cavity formed in the sole member. In certain embodiments of the invention only one of the first and second ends of the pliable body is fixed to the sole member. When only one end of the pliable body is fixed to the sole, a lever arm is created, wherein a free end of the lever arm bends into the sole's cavity under the heel force of the user. Additionally, a portion of the pliable body may have a loop shape, a flattened strap shape, or other shape as further described herein.

In accordance with aspects of the invention, an embodiment of the invention includes footwear having a sole member, a foot retaining member, and a heel contact member. The sole member has a top portion and a bottom portion, wherein the top portion of the sole member includes a toe receiving portion, a mid portion and a heel receiving portion. The foot retaining member is coupled to the sole member. The heel receiving portion includes a cavity formed in and extending into the sole member from the top portion of the sole member. The heel contact member is coupled to the sole member at the heel receiving portion of the sole member. The heel contact member has a first relaxed position wherein an upper portion of the heel contact member extends above the top portion of the sole member when in the relaxed position. The heel contact member also has a second position wherein the upper portion of the heel contact member deforms into the cavity formed in the heel receiving portion of the sole member when a force is applied against the heel contact member.

In accordance with embodiments of the invention the foot retaining member may be comprised of a strap having opposing ends of the strap fixed to the sole member. Also, the heel contact member may deform when a heel presses against the heel contact member. When the heel contact member deforms at least a portion of the heel contact member recedes into the cavity formed in the sole member. In some embodiments the foot retaining member is comprised of a strap having opposing ends of the strap fixed to the sole member at the mid portion of the sole member. The heel contact member may have a first end and a second end, wherein only one of the first and second ends of the heel contact member is fixed to the sole member. Alternatively, both ends of the heel contact member may be fixed to the sole member. A portion of the heel contact member may have a loop shape, a flattened strap shape, or other shape capable of deforming into the cavity formed in the sole member.

Those skilled in the art will appreciate that the present invention may be incorporated into a variety of footwear configurations in accordance with the present invention. By way of example, without limitation intended, the cavity that receives the foot contact member may be formed into the sole of a sandal, slip-ons, high heels, or other open heeled footwear. Likewise the size and shape of the foot contact member may be modified to accommodate changing footwear styles without departing from the scope of the invention. Further, it will be appreciated that the sole may be adapted to accommodate a removable foot retaining strap. Also, the ends of the various shaped resilient heel contact member may be constructed to join to the sole member in an interchangeable but fixed relation.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
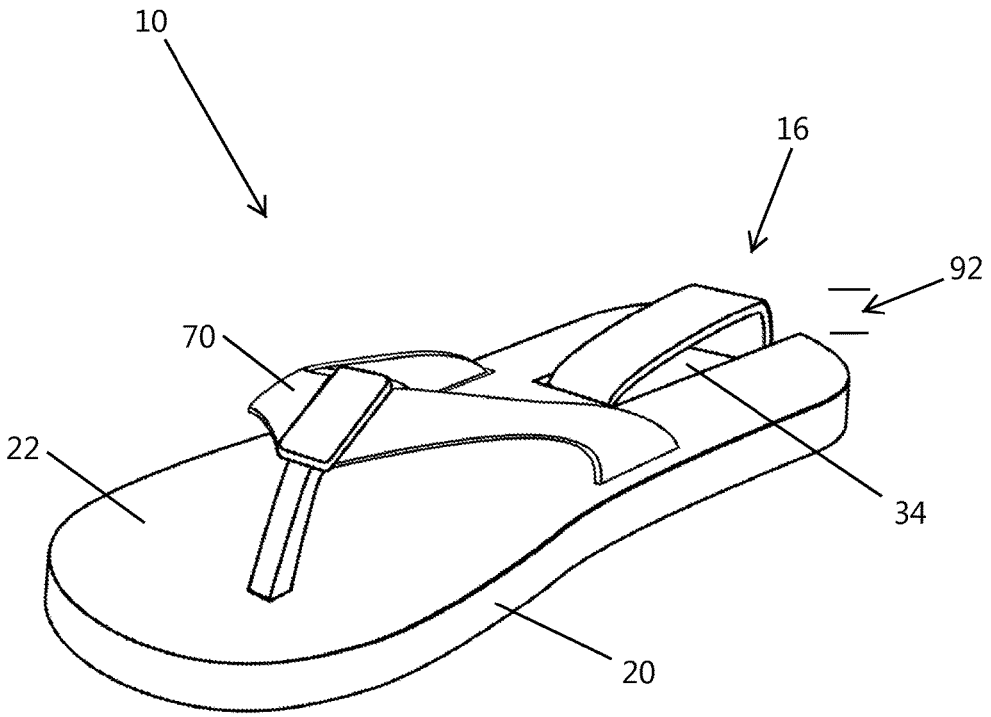
FIG. 1 is a front right perspective view of an embodiment of footwear of the present invention showing a heel contact member in the relaxed position.
Figure 2:
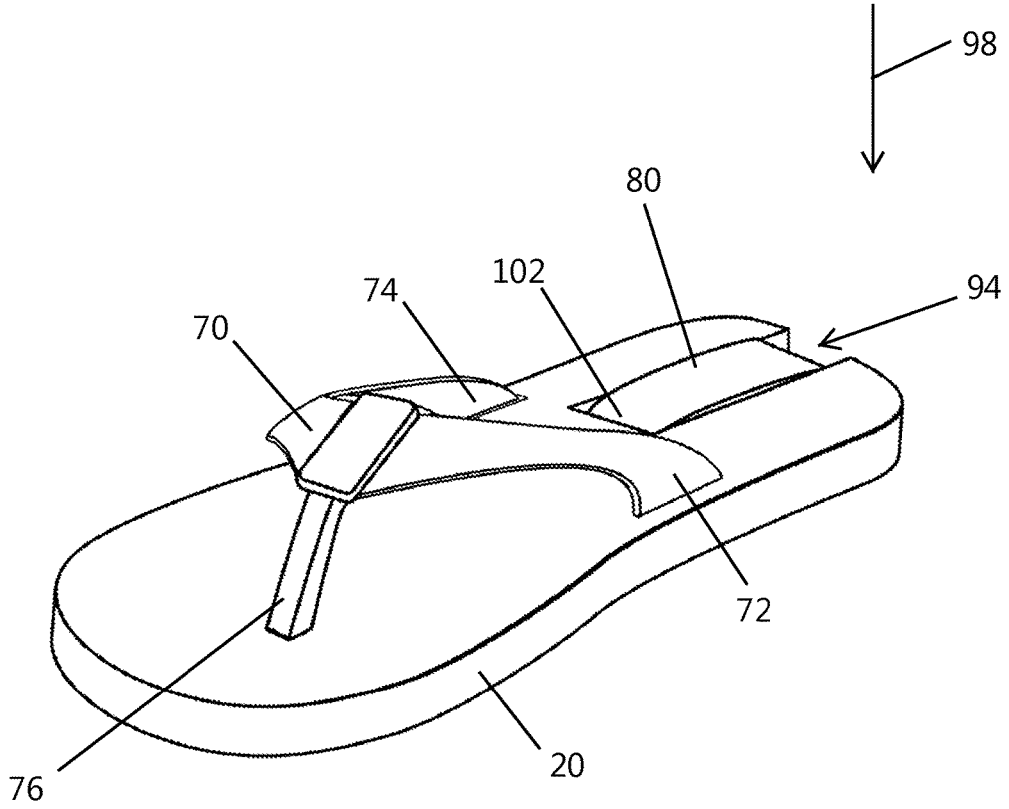
FIG. 2 is a front right perspective view of an embodiment of the footwear of the type shown in FIG. 1 showing the heel contact member in the compressed position.
Figure 3:
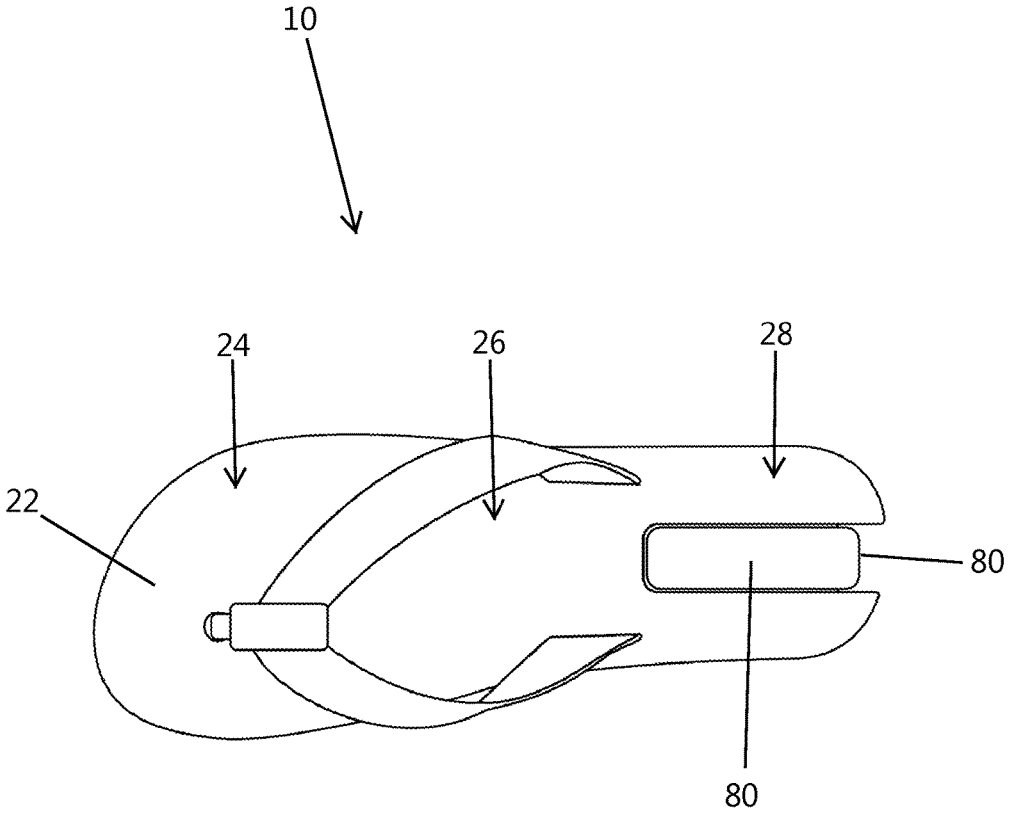
FIG. 3 is a top view of the footwear of the type shown in FIG. 1.
Figure 4:
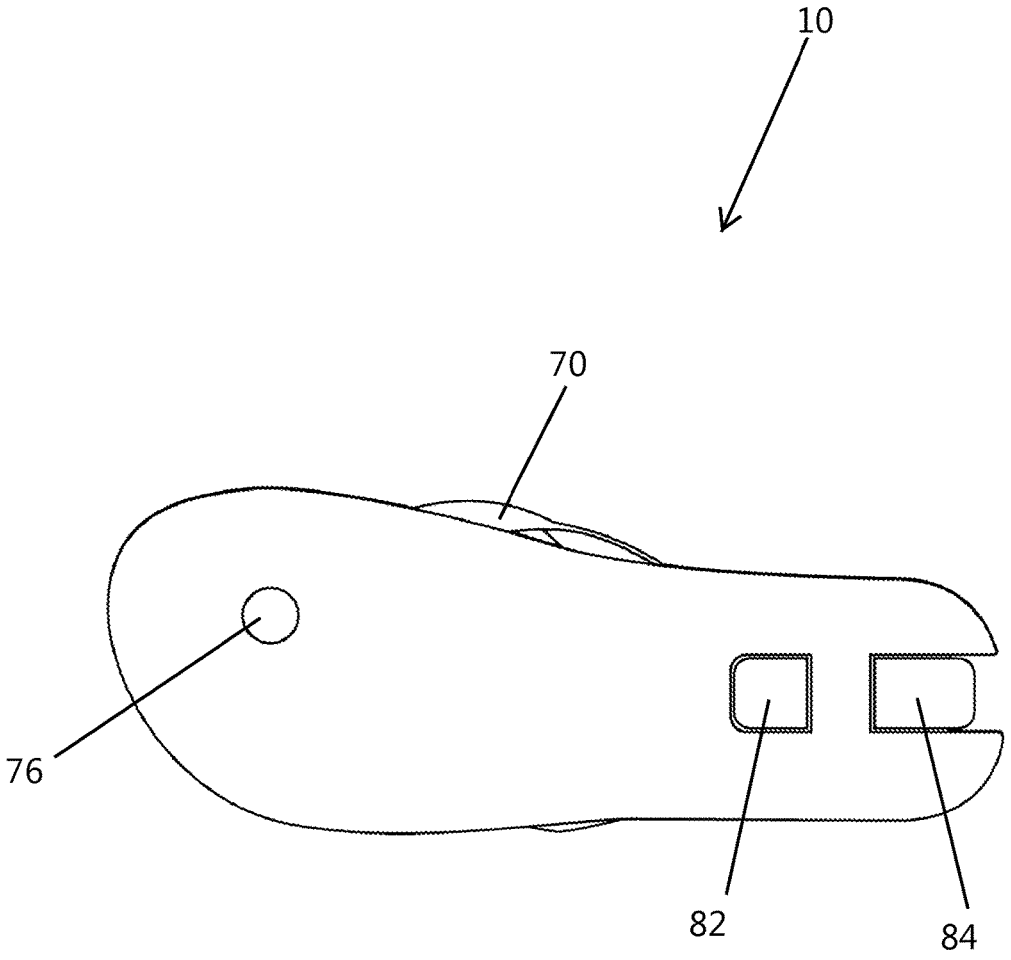
FIG. 4 is a bottom view of the footwear of the type shown in FIG. 1.
Figure 5:
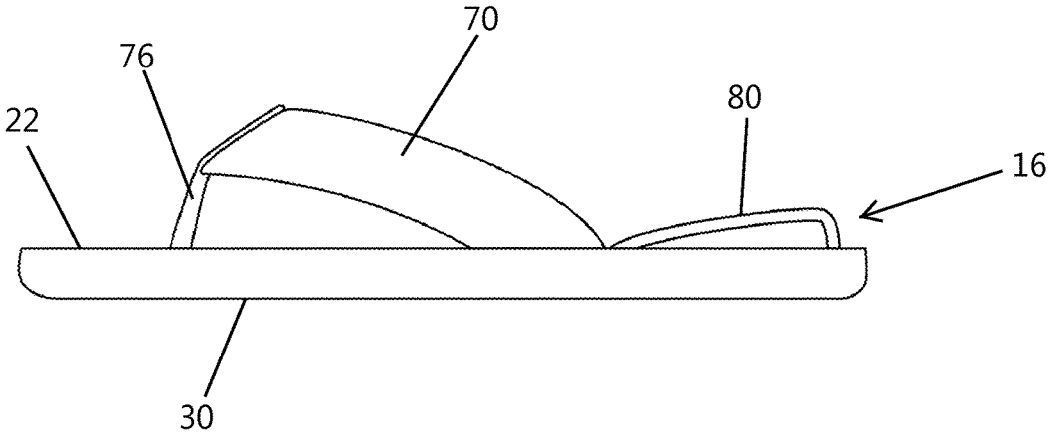
FIG. 5 is a right side elevational view of the footwear of the type shown in FIG. 1.
Figure 6:
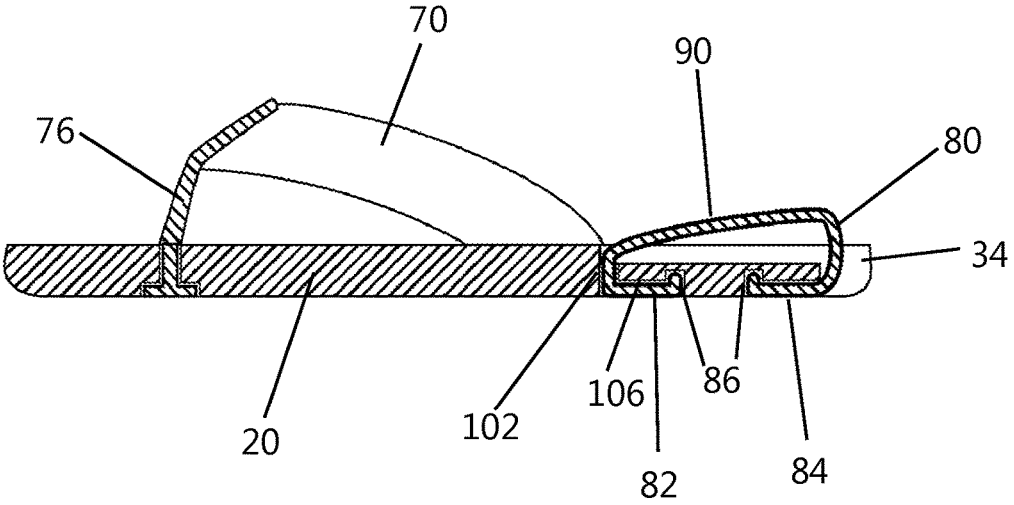
FIG. 6 is a partial cross sectional right side elevational view of the footwear of the type shown in FIG. 1.

The following description provides detail of various embodiments of the invention, one or more examples of which are set forth below. Each of these embodiments are provided by way of explanation of the invention, and not intended to be an undue limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The present invention is particularly well suited to reduce the slap and noise associated with the open heeled footwear 10 slapping against the wearer's heel 14. The footwear 10 generally includes a heel contact member 16 integrated into a sole 20 of the footwear 10. In accordance with aspects of the invention, a heel contact member 16 is provided that tends to stay in contact with a wearer's heel 14 even as the footwear bends while walking. Those skilled in the art will appreciate that the sole member 20 may comprise multiple layers including an insole, mid sole and out sole. For purposes of discussion, and without limitation intended, the sole member 20 is generally shown in the Figures as having a top side or top portion 22 (which is at the uppermost layer of multi layered soles) and a bottom side or bottom portion 30 (which is at the lower most layer of multi layered soles). The top portion 22 may be further characterized or divided into regions designated as a toe receiving segment 24, a mid-segment 26 and heel receiving segment 28.

The heel contact member 16 may be constructed of a resilient, pliable material that bends or otherwise deforms under the heel force of a user. The resilient material returns to its relaxed or original form as the heel force is reduced. When in a relaxed position the heel contact member 16 extends above a top portion 22 of the footwear's sole 20 and when in a deformed position the heel contact member 16 deforms or bends into a cavity 34 formed in the sole 20. Various embodiments according to aspects of the invention may provide materials and a modified structure to provide a preset tension or outward bias of the heel contact member from the cavity when the heel contact member is in the relaxed position. By way of example and without limitation intended, a level arm may be coupled to the sole at one end of the lever arm with a pivot joint. A compression spring may be biased under the lever arm to provide an upward bias of the lever arm to the relaxed position of the lever arm. Alternatively, the composition of the lever arm may provide a natural outward bias from the cavity. When a downward force is applied to the heel contact member the heel contact member at least partially retracts, bends, deforms or otherwise recedes into the cavity and reduces the distance that the heel contact member extends above the top portion of the sole. The downward force may act against the outward bias or natural resistance of the heel contact member.

Those skilled in the art will appreciate that the shape, size and configuration of cavity 34 may be varied to accommodate the various sizes and configurations of the heel contact member 16. The resilient member 16 is positioned towards the back end or heel receiving segment 28 of the sole 20 and contacts the user's heel 16 to reduce the slapping and flip flop sound while walking. The resilient member 16 and cavity 34 formed in the sole 20 are particularly well suited for open heeled footwear 10 to reduce the flopping sound when a user walks in the footwear 10.

Various embodiments of the invention include an open heeled footwear 10 having a foot retaining strap or upper 70. The strap or upper 70 has a first end 72 fixed to one side of the sole 20 at or near the mid-segment 26 of the sole 20 and has a second end 74 fixed to an opposing side of the sole 20. In some embodiments of the invention the strap is sized and shaped for incorporation into a sandal while other embodiments utilize a wider upper that may enclose the mid-segment 26 and toe receiving segment 24 or enclose the mid-segment region 26 while leaving the toe receiving region 24 open (not illustrated in the Figures). Those skilled in the art will appreciate that the many variations and styles of footwear may have varying sizes and shapes of the foot retaining strap or upper 70 to engage a top mid portion of a user's foot. Thus, the present invention may be incorporated into many different styles and fashions of footwear, including sandals, without departing from the scope of the invention. The sandal embodiments of the invention may further include a toe tab 76 extending from the strap 70 and coupled or fixed to the sole at the toe receiving segment 24 region of the sole 20.

Figure 7:
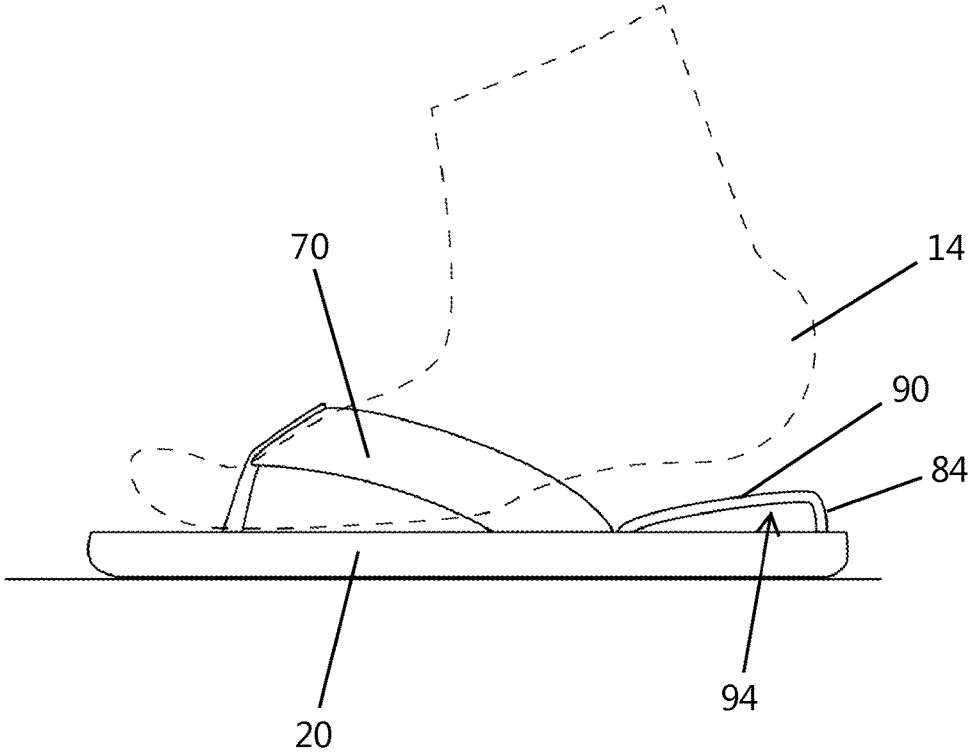
FIG. 7 is a right side elevational view of the footwear of the type shown in FIG. 1 illustrating in dashed lines a user's heel elevated above a heel contact member of the present invention.
Figure 8:
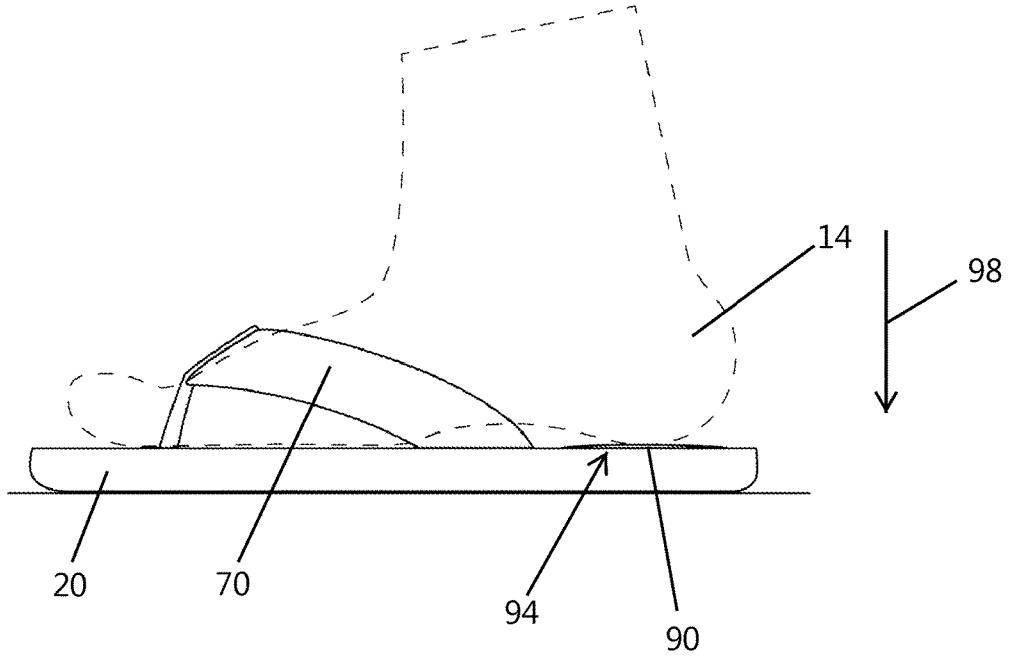
FIG. 8 is a right side elevational view of the footwear of the type shown in FIG. 1 illustrating in dashed lines a user's heel compressing a heel contact member of the present invention into the sole of the footwear.
Figure 9:
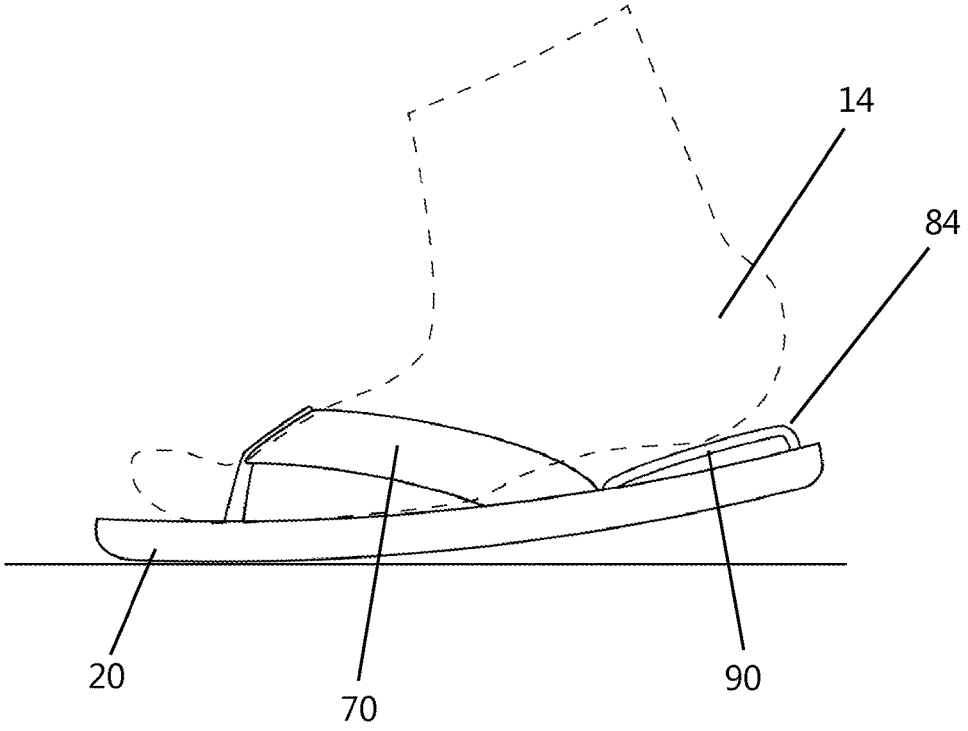
FIG. 9 is a right side elevational view of the footwear of the type shown in FIG. 1 illustrating in dashed lines a user's heel in slight contact with a heel contact member of the present invention.
Figure 10:
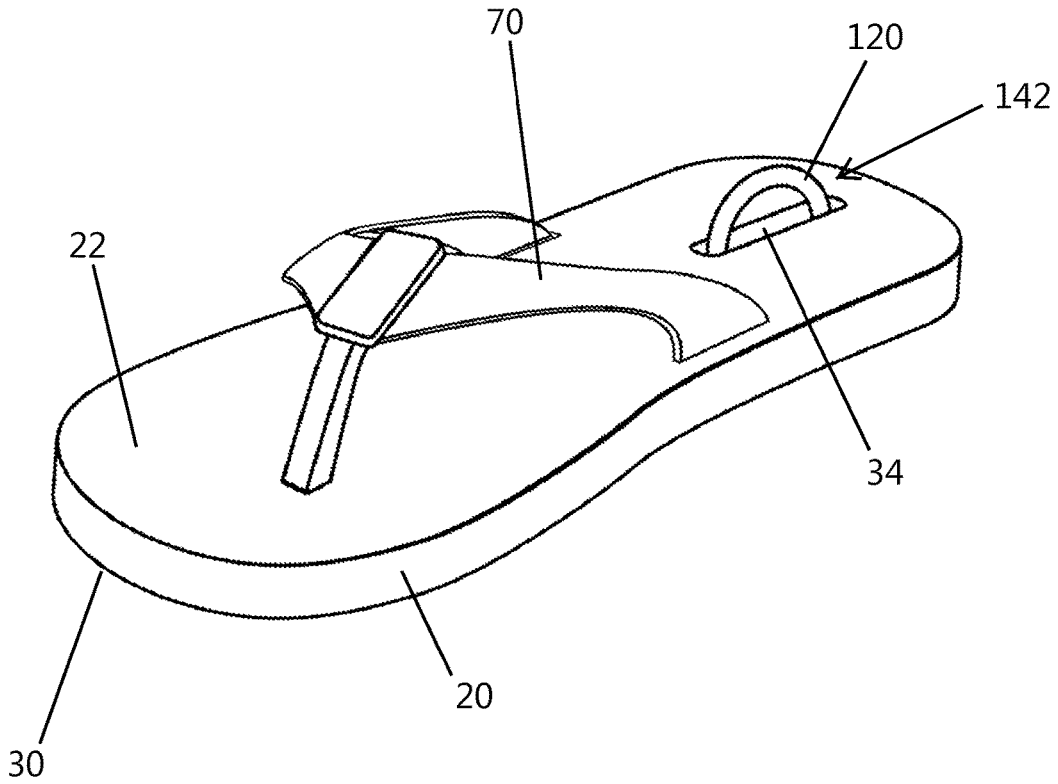
FIG. 10 is a front right perspective view of an embodiment of footwear of the present invention showing a heel contact member in the relaxed position.
Figure 11:
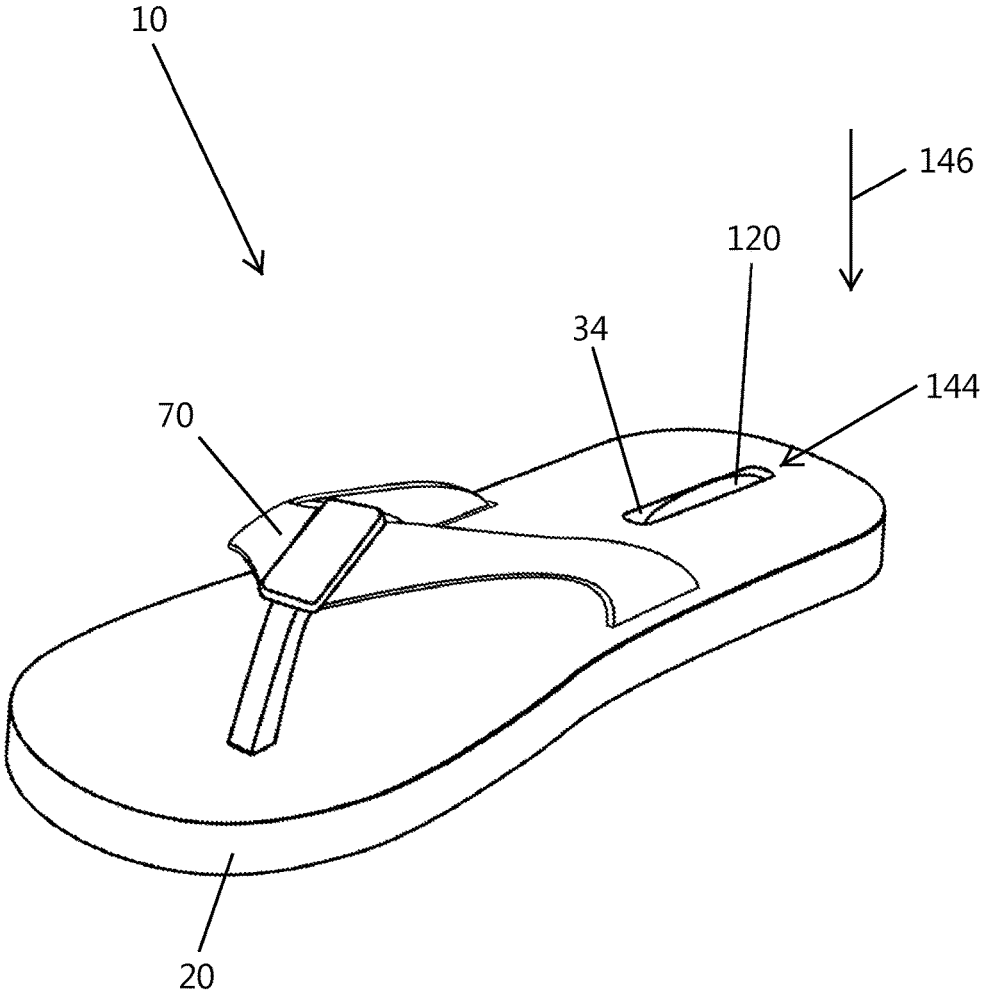
FIG. 11 is a front right perspective view of an embodiment of the footwear of the type shown in FIG. 10 showing the heel contact member in the compressed position.
Figure 12:
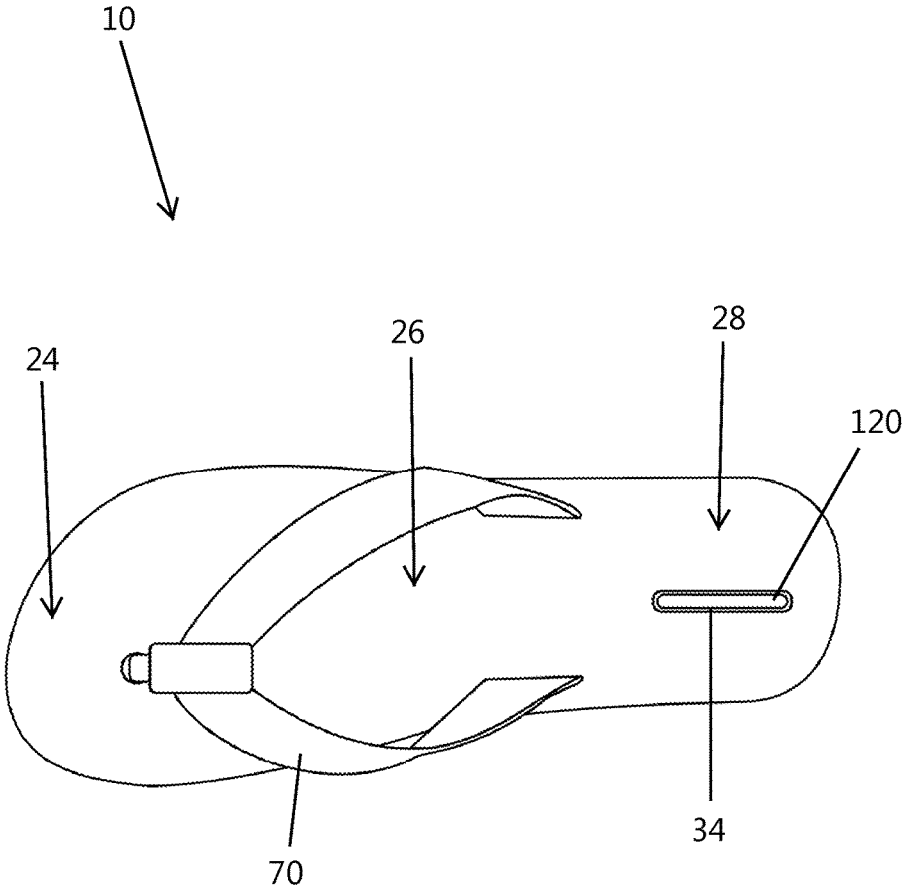
FIG. 12 is a top view of the footwear of the type shown in FIG. 10.
Figure 13:
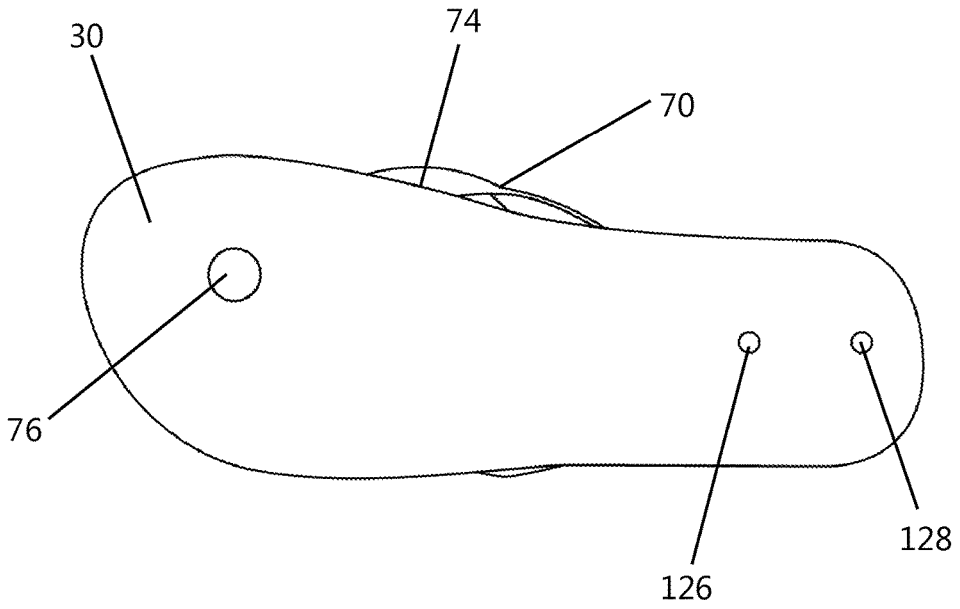
FIG. 13 is a bottom view of the footwear of the type shown in FIG. 10.
Figure 14:
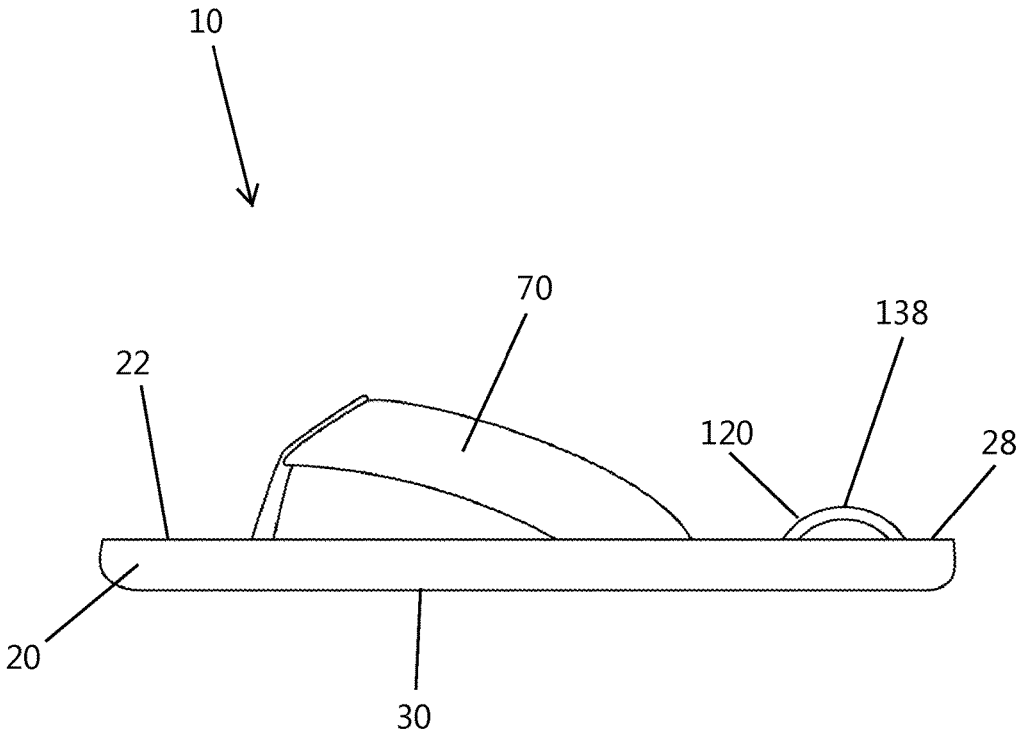
FIG. 14 is a right side elevational view of the footwear of the type shown in FIG. 10.
Figure 15:
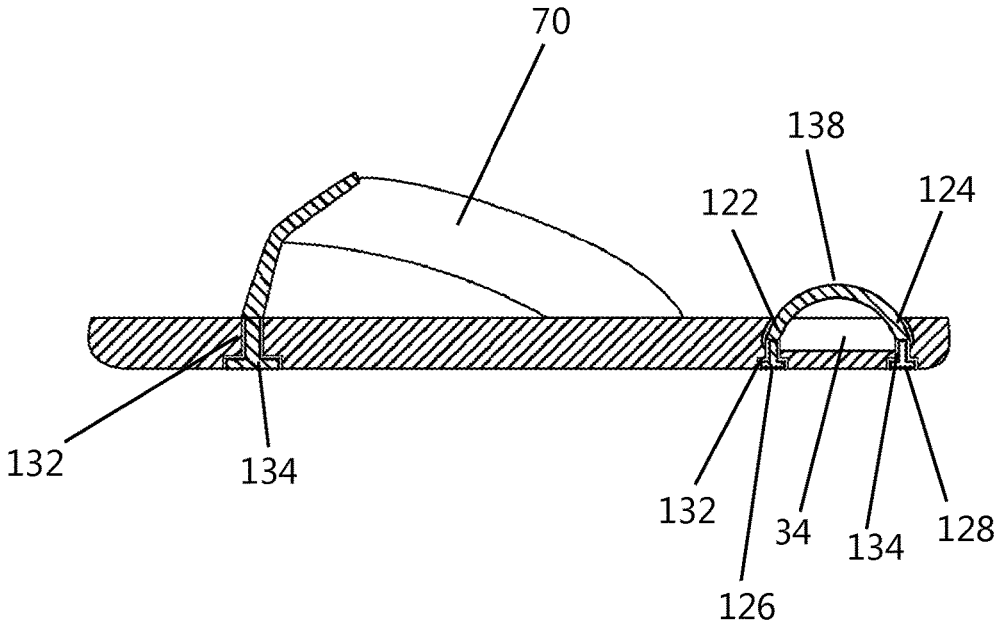
FIG. 15 is a partial cross sectional right side elevational view of the footwear of the type shown in FIG. 10 showing the heel contact member in the relaxed position.
Figure 16:
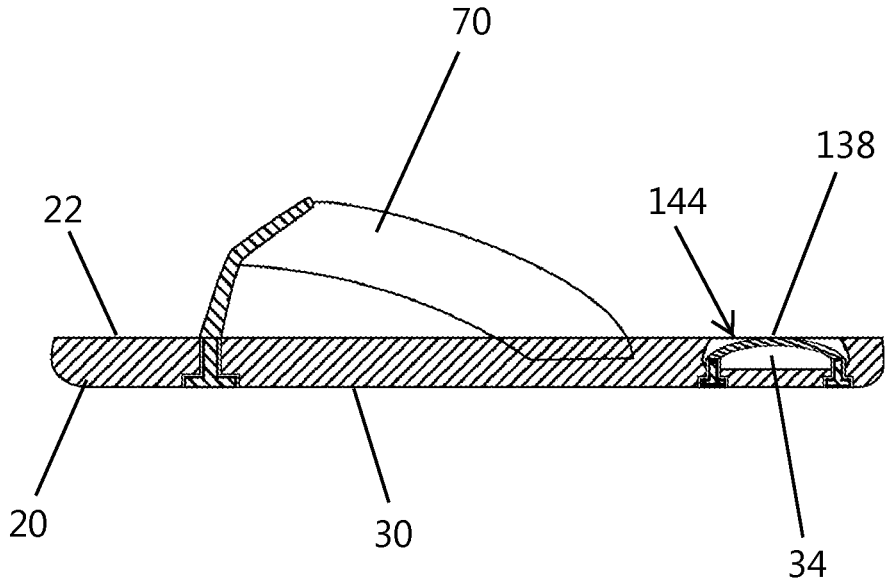
FIG. 16 is a partial cross sectional right side elevational view of the footwear of the type shown in FIG. 10 showing the heel contact member in the compressed position.

With reference to the Figures various aspects of the invention will be further described. FIGS. 1-9 illustrates an exemplary sandal style footwear 10 in accordance with an embodiment of the invention having a flattened band style heel contact member 80. The band 80 has first and second ends 82 and 84 having hook 86 formed on each end that couples the band 80 to the sole 20. Slots and grooves 104 and 106 are formed and extend in the sole 20. The ends 82 and 84 are routed through slots 104 and engage to a lower or bottom portion of the sandal within the grooves 106. When the hook 86 on each end 82 and 84 engages to the groove 106, the band resists pulling out of the slot 104. A heel contact portion 90 of the band 80 extends above a surface of the top portion 22 of the sole 20 when the band 80 is in a relaxed position 92. When the band 80 is in a deformed 94 condition caused by a downward force (represented by arrow 98) the band deforms or compresses into cavity 34 formed in the sole 20. FIG. 7 illustrates the shape and position of the band 80 prior to a user's heel 14 contacting the band. FIG. 8 illustrates the deformation of the band 80 into cavity 34 when the heel contacts the band. FIG. 9 illustrates a bend in sole 20 while the band 80 remains in contact with the user's heel 14.

Figure 17:
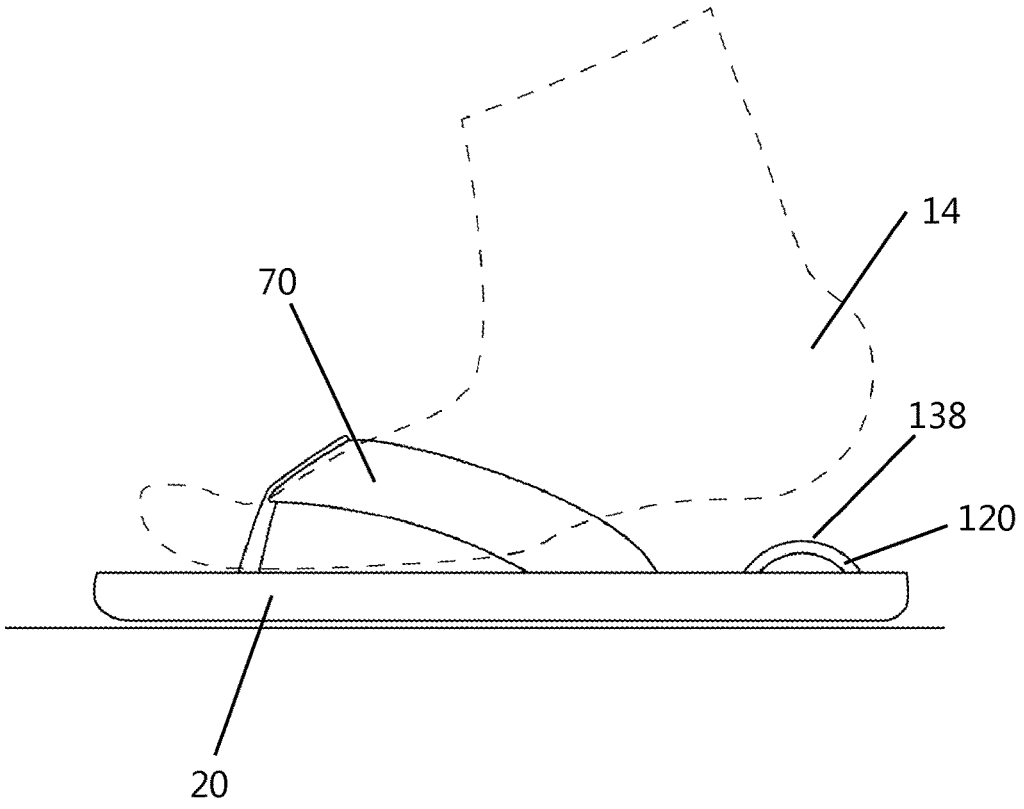
FIG. 17 is a right side elevational view of the footwear of the type shown in FIG. 10 illustrating in dashed lines a user's heel elevated above a heel contact member of the present invention.
Figure 18:
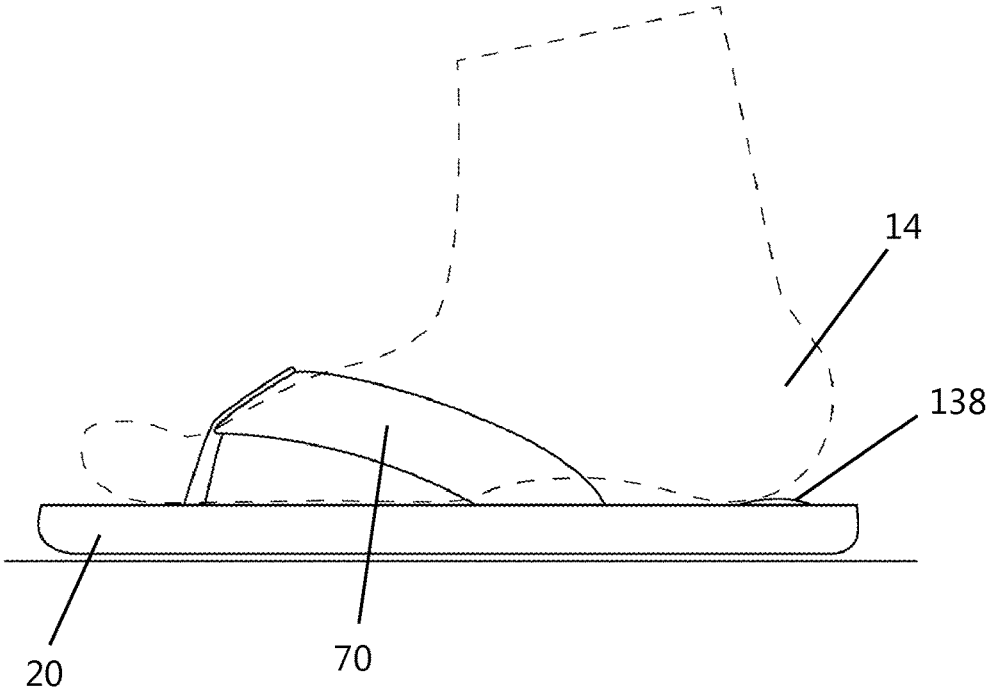
FIG. 18 is a right side elevational view of the footwear of the type shown in FIG. 10 illustrating in dashed lines a user's heel compressing a heel contact member of the present invention into the sole of the footwear.
Figure 19:
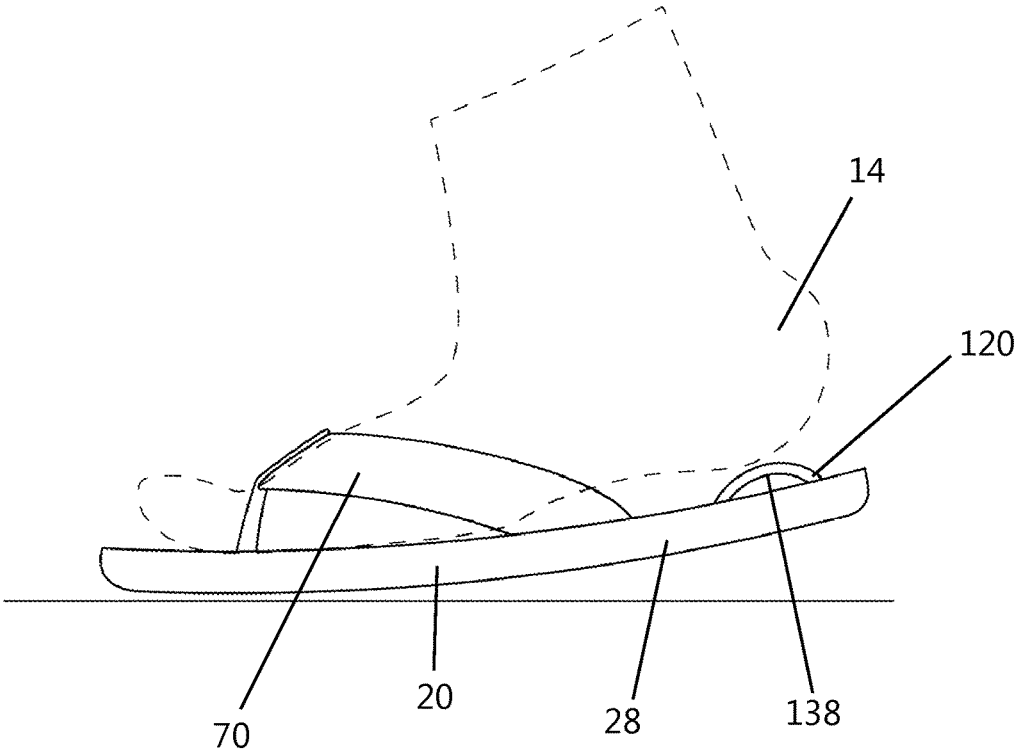
FIG. 19 is a right side elevational view of the footwear of the type shown in FIG. 10 illustrating in dashed lines a user's heel in slight contact with a heel contact member of the present invention.
Figure 20:
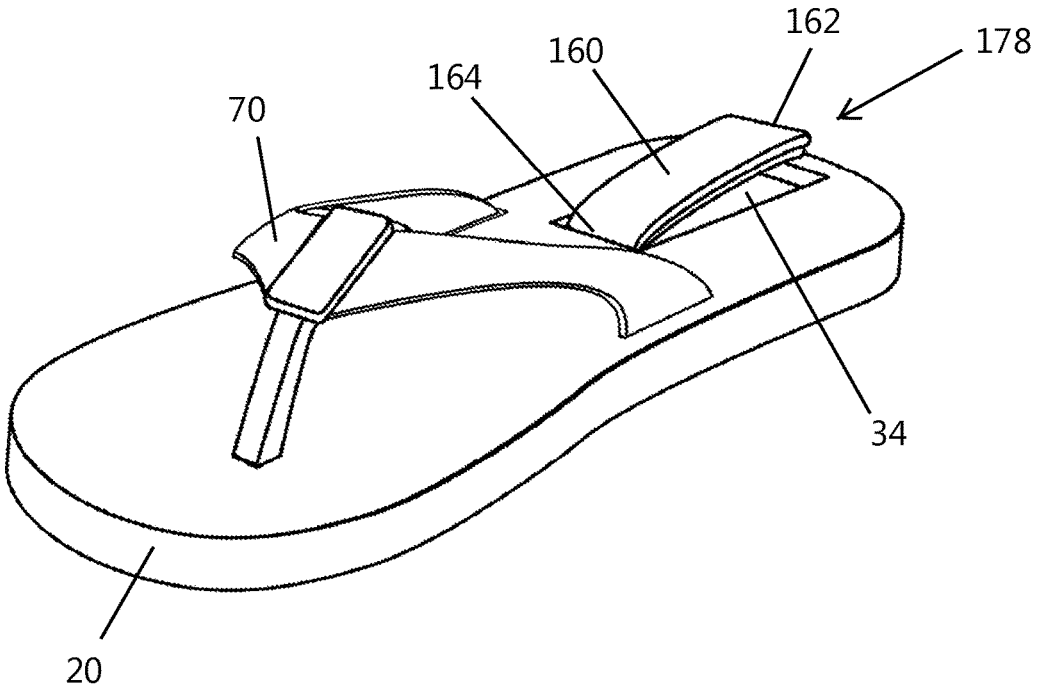
FIG. 20 is a front right perspective view of an embodiment of footwear of the present invention showing a heel contact member in the relaxed position.
Figure 21:
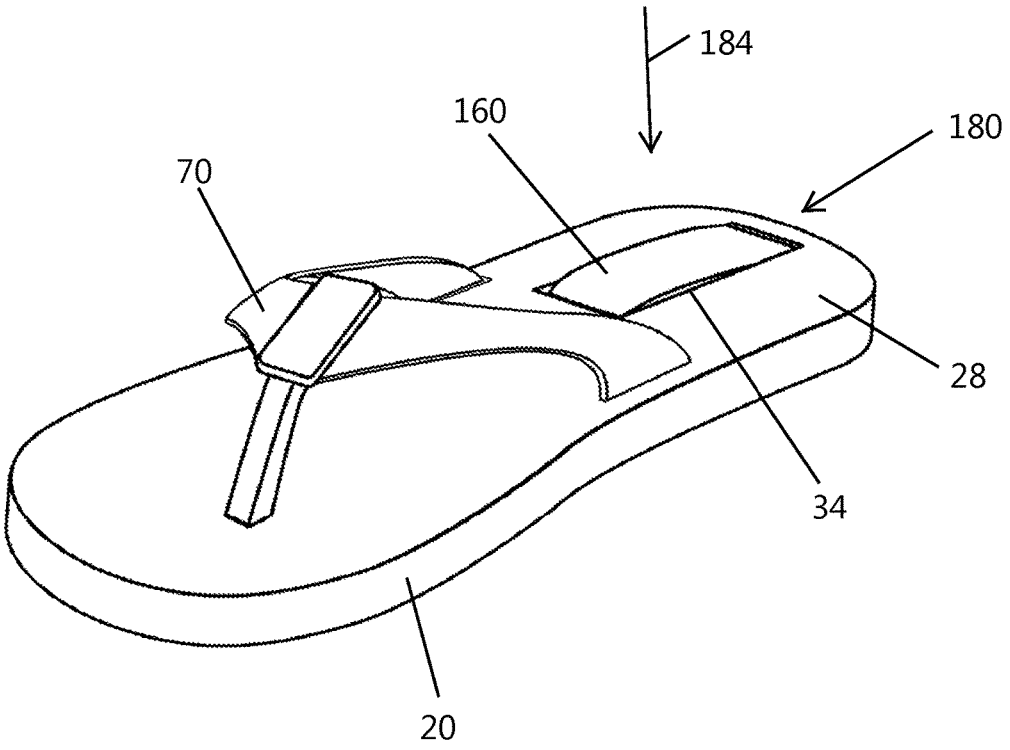
FIG. 21 is a front right perspective view of an embodiment of the footwear of the type shown in FIG. 20 showing the heel contact member in the compressed position.
Figure 22:
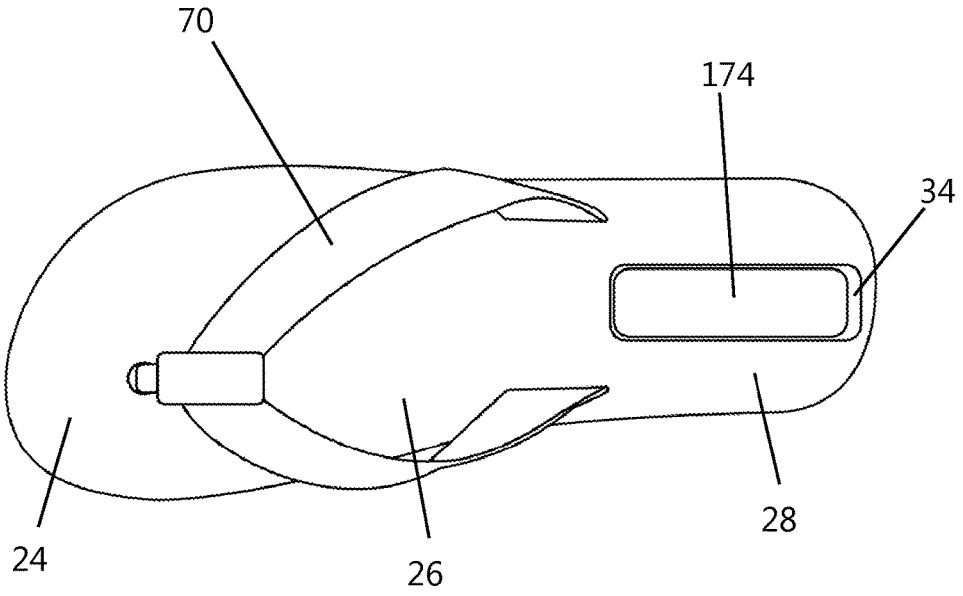
FIG. 22 is a top view of the footwear of the type shown in FIG. 20.
Figure 23:
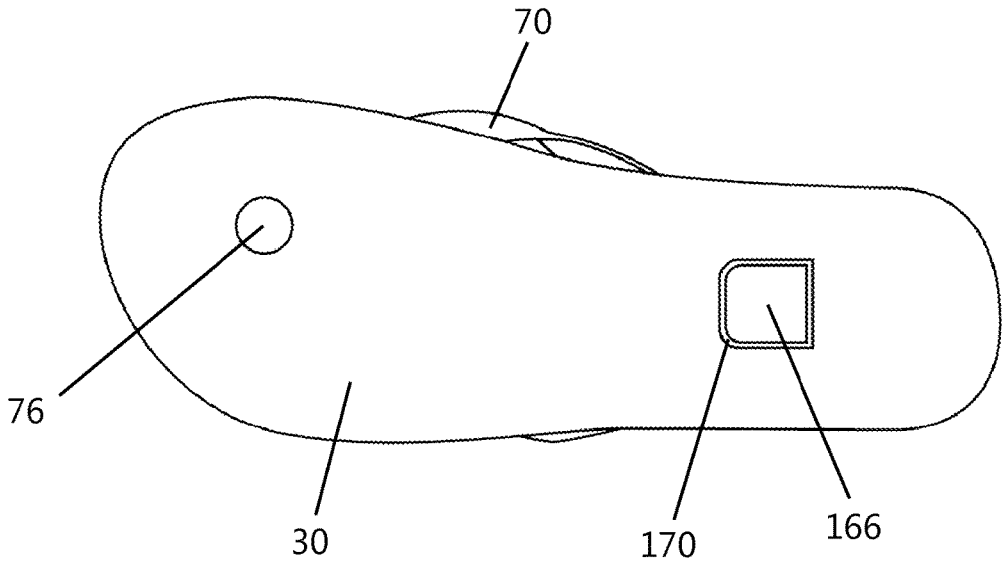
FIG. 23 is a bottom view of the footwear of the type shown in FIG. 20.
Figure 24:
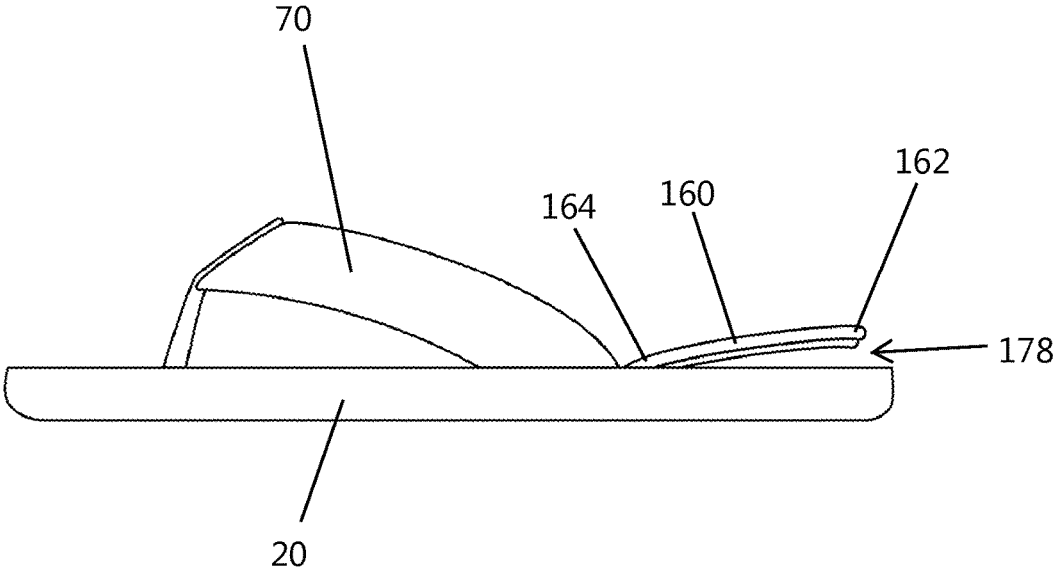
FIG. 24 is a right side elevational view of the footwear of the type shown in FIG. 20.
Figure 25:
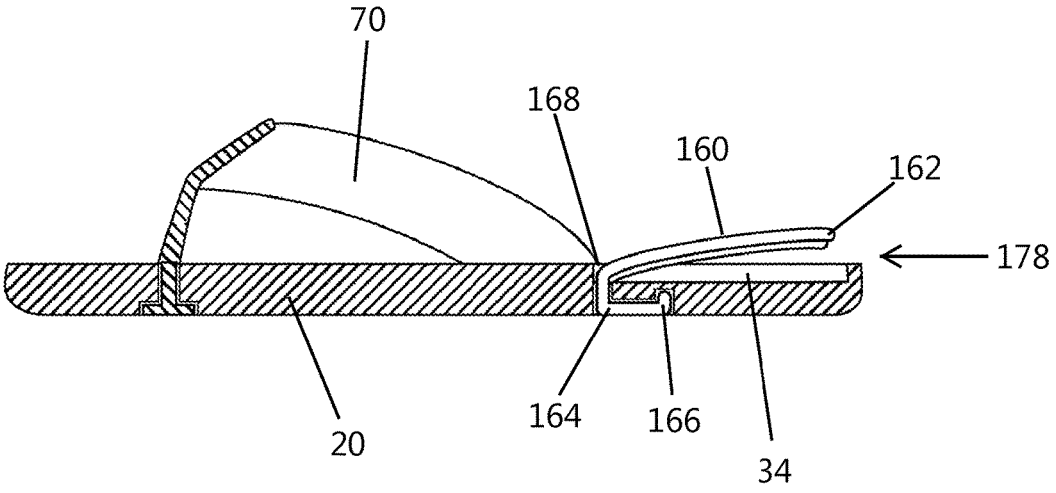
FIG. 25 is a partial cross sectional right side elevational view of the footwear of the type shown in FIG. 20 showing the heel contact member in the relaxed position.
Figure 26:
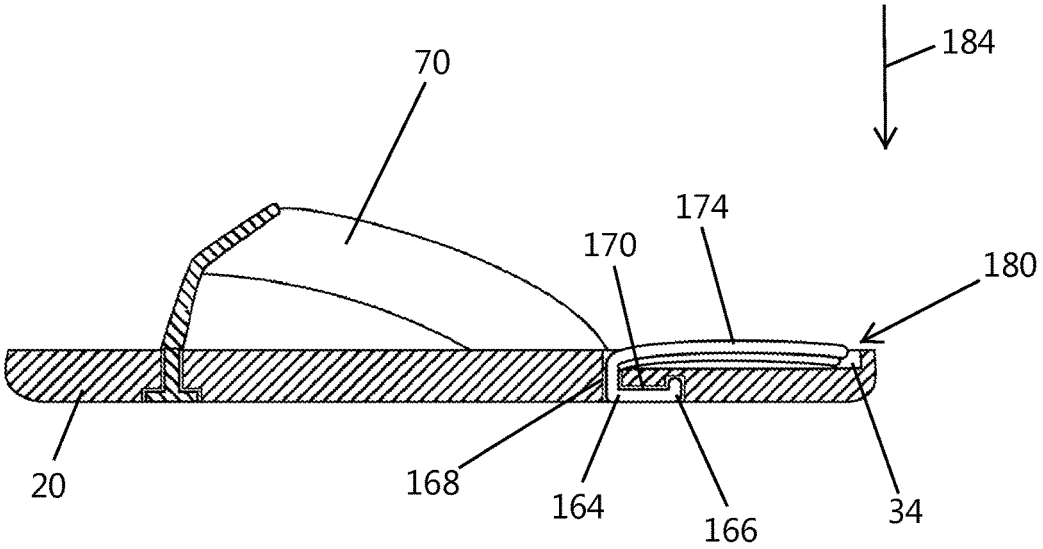
FIG. 26 is a partial cross sectional right side elevational view of the footwear of the type shown in FIG. 20 showing the heel contact member in the compressed position.

FIGS. 10-19 further illustrates another exemplary sandal style footwear 10 in accordance with an embodiment of the invention having a loop style heel contact member 120. The loop 120 has first and second ends 122 and 124 having joints 126 and 128 formed on respective ends of the loop 120. The joints 126 and 128 couples the loop 120 to the sole 20. Aperture and channel 132 and 134 are formed and extend in the sole 20. The ends 122 and 124 are routed through apertures 132 and engage to a lower or bottom portion of the sandal within the channels 134. When the joints 126 and 128 on each end 122 and 124 engage to the channels 134 the loop 120 resists pulling out of the apertures 132. A heel contact portion 138 of the loop 120 extends above a surface of the top portion 22 of the sole 20 when the loop 120 is in a relaxed position 142. When the loop 120 is in a deformed condition 144 caused by a downward weight of the user's heel (represented by arrow 146) the loop 120 deforms or compresses into cavity 34 formed in the sole 20. FIG. 17 illustrates the shape and position of the loop 120 prior to a user's heel 14 contacting the loop. FIG. 18 illustrates the deformation of the loop 120 into cavity 34 when the heel contacts the loop. FIG. 19 illustrates a bend in sole 20 while the loop 120 remains in contact with the user's heel 14.

FIGS. 20-29 illustrates an exemplary sandal style footwear 10 in accordance with an embodiment of the invention having a flattened lever arm style heel contact member 160.

Figure 27:
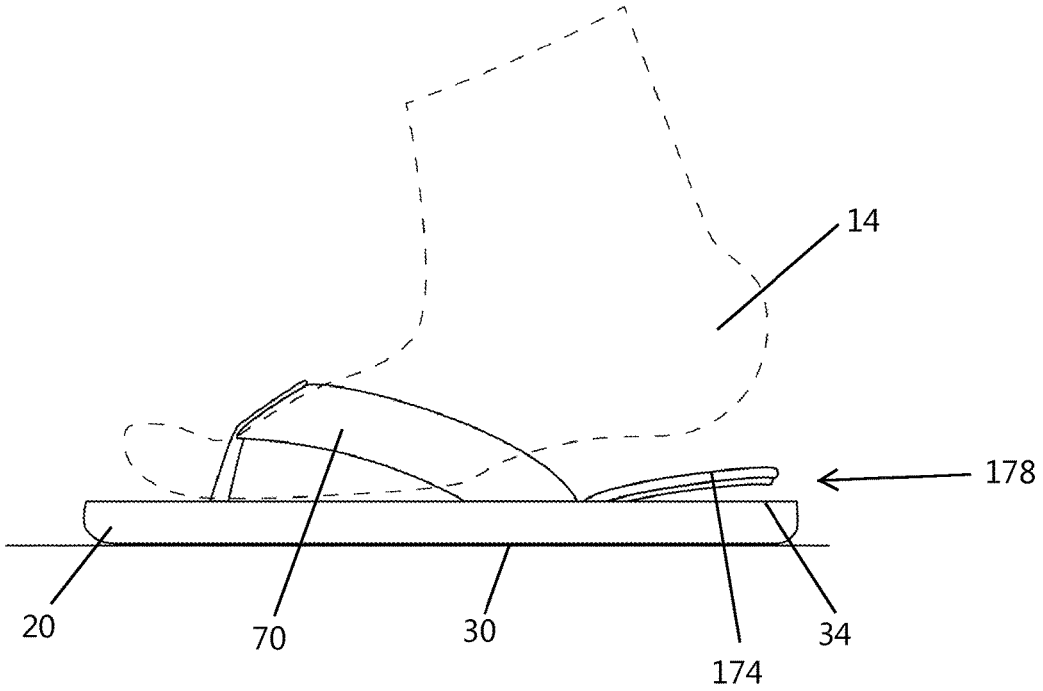
FIG. 27 is a right side elevational view of the footwear of the type shown in FIG. 20 illustrating in dashed lines a user's heel elevated above a heel contact member of the present invention.
Figure 28:
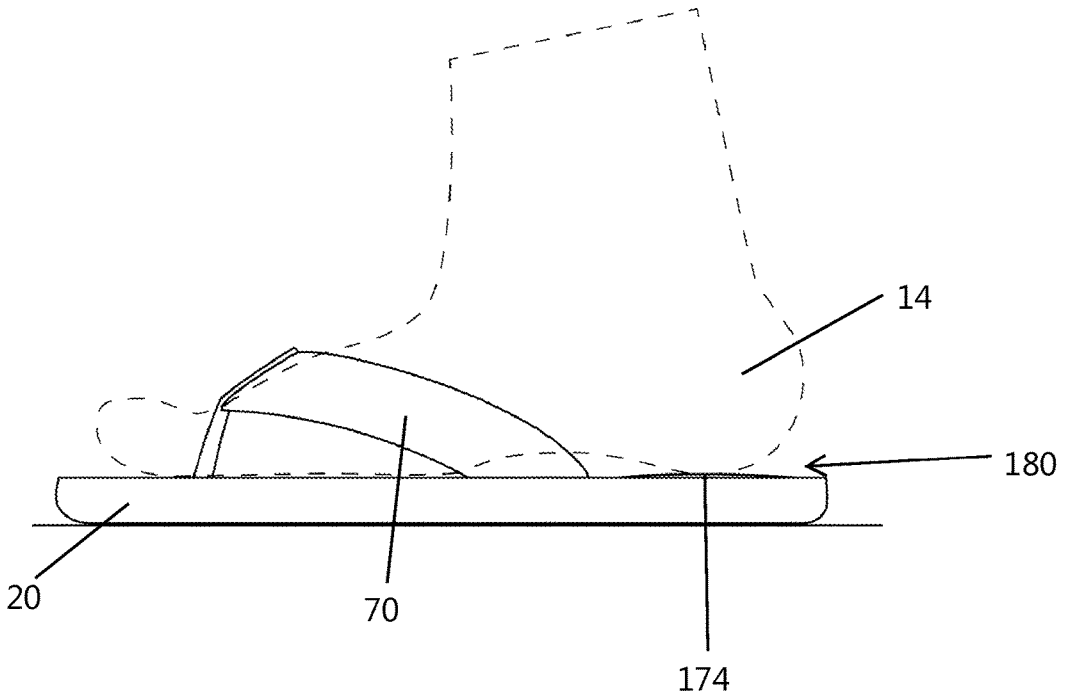
FIG. 28 is a right side elevational view of the footwear of the type shown in FIG. 20 illustrating in dashed lines a user's heel compressing a heel contact member of the present invention into the sole of the footwear.
Figure 29:
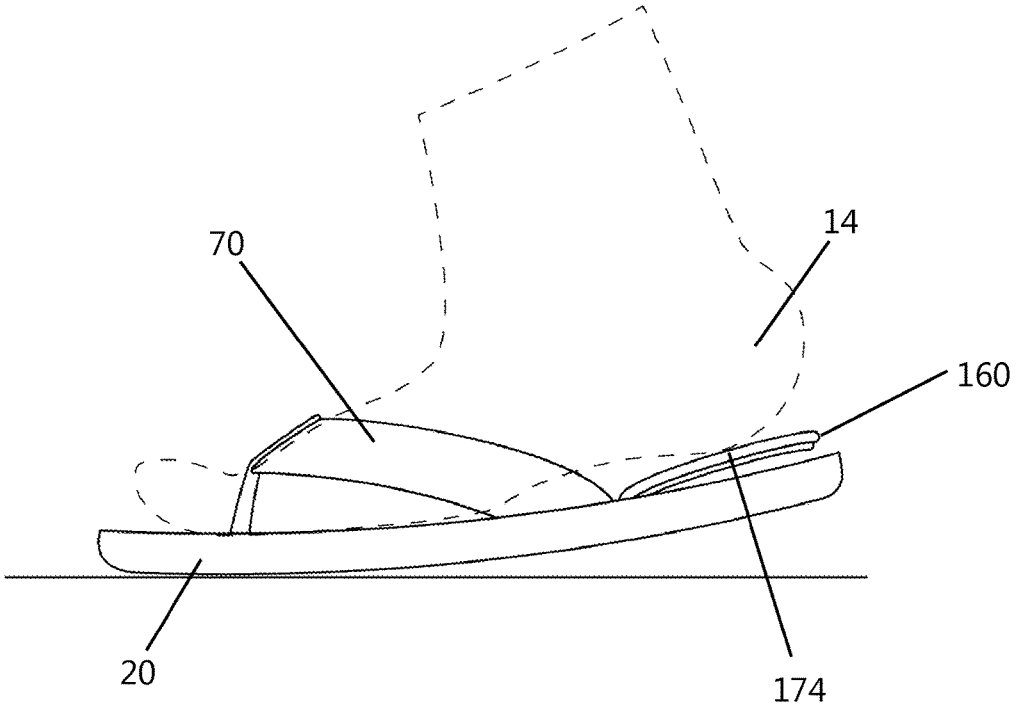
FIG. 29 is a right side elevational view of the footwear of the type shown in FIG. 20 illustrating in dashed lines a user's heel in slight contact with a heel contact member of the present invention.

The lever arm 160 has a first free end 162 and second fixed end 164, wherein the fixed end 164 is coupled to sole 20 and the free end pivots downward into the cavity 34. Slots and grooves 168 and 170 are formed and extend in the sole 20. The fixed end 164 is routed through slot 168 and engages to a lower or bottom portion of the sandal within the groove 170. When hook 166 on fixed end 164 engages to the groove 170, the lever arm 160 resists pulling out of the slot 168. A heel contact portion 174 of the lever arm 160 extends above a surface of the top portion 22 of the sole 20 when the lever 160 is in a relaxed condition or position 178. When the lever 160 is in a depressed or deformed condition or position 180, caused by a downward force (represented by arrow 184) the lever deforms or deflects into cavity 34 formed in the sole 20. FIG. 27 illustrates the shape and position of the lever 160 prior to a user's heel 14 contacting the lever. FIG. 28 illustrates the deflection of the lever 160 into cavity 34 when the heel contacts the lever. FIG. 29 illustrates a bend in the sole 20 while the lever 160 remains in contact with the user's heel 16.

The various embodiments described herein are illustrative of the present invention and not limiting as to the scope and spirit of the present invention. These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A footwear device, said device comprising:

a sole member having a top portion and a bottom portion, wherein the top portion of said sole member is divisible into a toe receiving segment, a mid-segment and a heel receiving segment;

a foot retaining member coupled to said sole member;

said heel receiving segment of said sole member includes a cavity formed in and extending into said sole member at said heel receiving segment, wherein said cavity extends into said sole member from the top portion of the heel receiving segment of said sole member; and a pliable lever coupled to said sole member at said heel receiving segment of said sole member, said pliable lever having a first free end and a second fixed end, wherein said first free end pivots downward into said cavity formed in said sole member and further wherein the second fixed end is coupled to the sole member within the cavity formed in the sole member.

2. The device as recited in claim 1, wherein said foot retaining member is comprised of a strap having opposing ends of said strap fixed to said sole member at the mid segment of said sole member.

3. The device as recited in claim 1, wherein the first free end of said pliable lever has a heel contact portion that extends above the top portion of said sole member when said pliable lever is in a relaxed position.

4. The device as recited in claim 3, wherein said pliable lever deforms when a force is directed towards said heel contact portion of the pliable lever.

5. The device as recited in claim 4, wherein when the pliable lever deforms at least a portion of the pliable lever recedes into the cavity formed in the sole member.

6. The device as recited in claim 1, wherein said pliable lever deforms under a heel weight of a user.

7. A footwear device, said device comprising:

a sole member having a top portion and a bottom portion, wherein said top portion of said sole member includes a toe receiving portion, a mid-portion and a heel receiving portion;

a foot retaining member coupled to said sole member;

said heel receiving portion including a cavity formed in and extending into said sole member from the top portion of the heel receiving portion of said sole member; and a lever arm coupled to said sole member at said heel receiving portion of said sole member, said lever arm having a first relaxed position wherein an upper free end portion of said lever arm extends above the top portion of the sole member when in the relaxed position, said lever arm further having a second position wherein said upper free end portion of said lever arm pivots into said cavity formed in said heel receiving portion of said sole member when a force is applied against said lever arm.

8. The device as recited in claim 7 wherein said lever arm deforms when a heel presses against the upper free end portion of the lever arm.

9. The device as recited in claim 8, wherein when said lever arm deforms at least a portion of the upper free end of the lever arm recedes into the cavity formed in the sole member.

10. The device as recited in claim 7, wherein said foot retaining member is comprised of a strap having opposing ends of said strap fixed to said sole member at the mid portion of said sole member.

11. The device as recited in claim 7, wherein a portion of said lever arm has a flattened upper and lower surface.

12. The device as recited in claim 7 wherein said lever arm deforms under a heel weight of a user.

13. A footwear device, comprising:

a sole member having a top portion and a bottom portion, wherein said top portion of said sole member includes a toe receiving portion, a mid-portion, and a heel receiving portion;

a foot retaining member coupled to said sole member;

said heel receiving portion including a cavity formed in and extending into said sole member from the top portion of the heel receiving portion of said sole member, wherein the cavity has a width and length that is less than the width and length of the heel receiving portion of the sole member; and a heel contact member coupled below a heel support surface of the heel receiving portion of said sole member in a manner that biases a portion of the heel contact member outwardly from said cavity, wherein an uppermost surface of said heel contact member is at least partially retractable into said cavity below the heel support surface of the heel receiving portion of the sole member and against a force applied to said heel contact member, wherein the heel contact member is comprised of a lever or a loop, wherein when the heel contact member is in a retracted position a heel of a user is supported by the heel support surface.

14. The device as recited in claim 13, wherein at least one end of the lever or loop of said heel contact member is coupled to said sole member within said cavity.

15. The device as recited in claim 13, wherein said heel contact member is completely retractable into said cavity under the applied force.

* * * * *